US005403471A

United States Patent [19]

Ushio et al.

[11] Patent Number: 5,403,471

[45] Date of Patent: Apr. 4, 1995

[54] PROCESS FOR HYDROGENATIVELY TREATING PETROLEUM DISTILLATION RESIDUAL OILS

[75] Inventors: Masaru Ushio; Kozo Kamiya; Toru Morita, all of Kanagawa, Japan

[73] Assignee: Nippon Oil Co., Ltd., Tokyo, Japan

[21] Appl. No.: 997,420

[22] Filed: Dec. 28, 1992

[30] Foreign Application Priority Data

Dec. 27, 1991 [JP] Japan ..... 3-358564

[51] Int. Cl.[6] ..... C10G 45/04

[52] U.S. Cl. ..... 208/251 H; 208/251 R; 208/177

[58] Field of Search ..... 208/251 R, 177, 252, 208/253, 251 H

[56] References Cited

U.S. PATENT DOCUMENTS 4,836,914 6/1989 Inoue ..... 208/251 H

FOREIGN PATENT DOCUMENTS 62-54790 3/1987 Japan .

*Primary Examiner*—Paul Lieberman
*Assistant Examiner*—Lorna M. Douyon
*Attorney, Agent, or Firm*—Panitch Schwarze Jacobs & Nadel

[57] ABSTRACT

A process is disclosed for refining distillation residual fractions of a crude petroleum oil. The process employs a high gradient magnetic separator for magnetically depositing iron impurities from such distillation residual oil onto a ferromagnetic filler in the separator. The ferromagnetic filler is cleaned at predetermined intervals by a selected class of washing liquids so that the refining operation can be carried out continually.

3 Claims, 1 Drawing Sheet

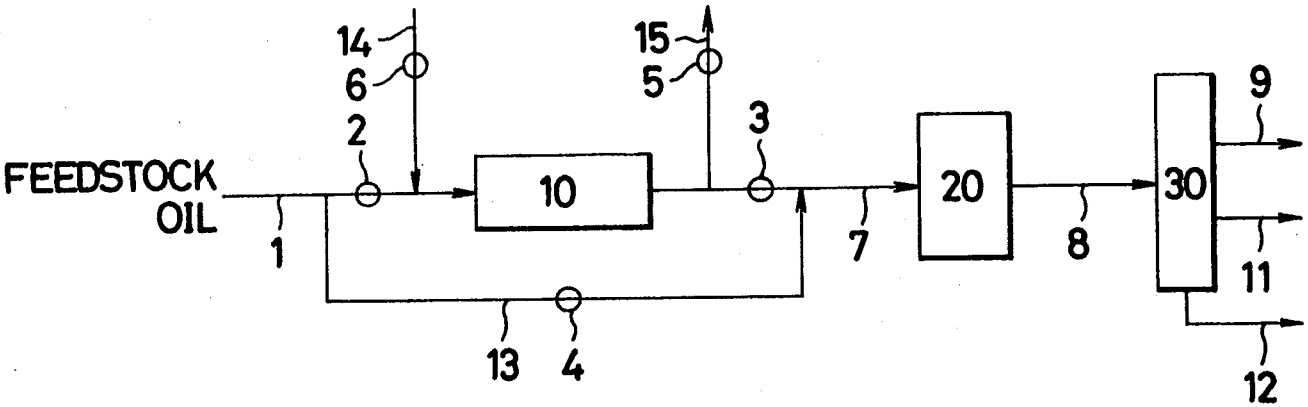
FEEDSTOCK OIL
1
2
14
6
10
13
4
15
5
3
7
20
8
30
9
11
12

PROCESS FOR HYDROGENATIVELY TREATING PETROLEUM DISTILLATION RESIDUAL OILS

BACKGROUND OF THE INVENTION

1. Field of the Invention

This invention relates to a hydrogenative treatment process for refining petroleum distillation residues. More specifically, the invention is directed to such a process in which petroleum distillation residues are magnetically treated to remove iron contents therefrom prior to hydrogenative treatment.

2. Prior Art

As has been commonly practiced in the art of petroleum refining, residual oils resulting from atmospheric or vacuum distillation of a crude petroleum oil are subjected to cracking, desulfurization and other reactions upon passage through a fixed-bed hydrogenation reactor.

In most cases, such residual oils contain considerable proportions of particulate iron or iron compounds which emanate during the transport of a crude oil from a shipping tanker through storage tank and delivery pipe lines to a distillation plant. Such iron impurities tend to deposit on a catalyst bed or in between individual catalyst particles, resulting in a plugged up reactor or deteriorated catalyst. A plugged up reactor would often lead to objectionably increased pressure to a point where the plant operation has to be discontinued. Particulate iron impurities present in petroleum distillation residues are usually of the order of 0.1–20 microns in size, too small to be removed by relatively large mesh filters commonly used at petroleum oil refineries.

There may be considered several alternatives for removing the iron impurities from petroleum residual oils to be treated. One would be to use a fine mesh filter such as a filter cloth or paper, but such filters entail large pressure loss, are easy to get clogged and very tedious to replace, and hence not suitable for application in petroleum refining where massive crude oil is handled. Another alternative would be to use a centrifugal separator, but this is practically infeasible in view of its structural and operational limitations.

In U.S. Pat. No. 4,836,914 and Japanese Laid-Open Patent Publication No. 62-54790 there is disclosed the use of a high gradient magnetic separator for iron removal. While the disclosed device can be successfully operated for certain initial periods of time, it has been found that the efficiency of removal of iron contents in a petroleum residual oil declines progressively with time chiefly due to fouling of the ferromagnetic filler by those iron particles which are continually deposited thereon in the magnetic field.

SUMMARY OF THE INVENTION

The present invention seeks to provide a process for hydrogenatively treating petroleum oil distillation residues which will eliminate or alleviate the foregoing difficulties of the prior art.

More specifically, the invention is directed to improvements in and relating to the last-mentioned prior art alternative relying on the use of a high gradient magnetic separator, in which iron impurities in a petroleum residual oil to be treated that are liable to deposit on a ferromagnetic filler in the separator will be washed away efficiently at predetermined intervals thereby maintaining continuous iron removal operation.

According to the invention, there is provided a process for hydrogenatively treating petroleum distillation residual oils containing greater than 5 ppm iron impurities which comprises treating the residual oil at a temperature in the range of room temperature to 400° C. by magnetically attracting the iron impurities onto a ferromagnetic filler at a magnetic field strength in the range of 500 to 25,000 gausses generated in a high gradient magnetic separator; washing the ferromagnetic filler at predetermined intervals with a washing liquid selected from the group of a petroleum distillation residual oil, a hydrogenated fraction thereof and distillation bottoms of such hydrogenated fraction; and subsequently subjecting the thus treated residual oil to fixed-bed hydrogenation treatment.

The above and other objects and features of the invention will be better understood from the following detailed description taken with reference to the accompanying drawing.

BRIEF DESCRIPTION OF THE DRAWING

The sole FIGURE is a process flow diagram schematically illustrating the process of the invention.

DETAILED DESCRIPTION OF THE INVENTION

It has now been found that iron deposits on a ferromagnetic filler in a high gradient magnetic separator can be effectively washed away by means of a selected class of washing liquids. Such washing liquids eligible for the purpose of the invention are typically petroleum oil distillation residues including such residues further hydrogenated or distillation bottoms of such hydrogenated residues.

The term petroleum oil distillation residue or residual oil as used herein designates atmospheric or vacuum distillation residual oils of a petroleum crude oil, mixtures or deasphalted products thereof. Such distillation residual oils are prone to capture fine particle of iron or iron compounds such as iron sulfides or iron oxides during transport or storage which tend to concentrate even as high as to about 10–100 ppm and which range in particle size from 0.1 to 100 microns, predominantly less than 20 microns.

The high gradient magnetic separator used in the invention is designed with a ferromagnetic filler capable of generating therearound a gradient of magnetic fields as high as from $100\times10^3$ to $20{,}000\times10^3$ gausses/cm. The ferromagnetic filler is in the form of a mass of small-gage ferromagnetic wires such as a steel wool, a steel net or an expanded metal having a mesh size of from 1 to 1,000 μm. Preferred examples include cut wires measuring from 0.01 mm to 2 mm in diameter and from 0.1 mm to 30 mm in length, steel beads of 0.5 to 5 mm diameter and cup-shaped metal strips of 0.1 to 5 mm diameter which are sold under the trademark of Bristo C by Japan Metallurgy Industries Ltd., the last-mentioned example being most preferred for the purpose of the invention.

Iron impurities in the distillation residual oil can be removed by magnetic attraction onto the ferromagnetic filler as the oil is passed through the space of magnetic fields being generated in the separator.

Optimum operating parameters for the high gradient magnetic separator may be chosen depending upon magnetic field strength, oil linear velocity, oil temperature, type and size of iron particles to be removed. The strength of magnetic fields to be generated around the ferromagnetic filler ranges generally from 500 to 25,000, preferably from 1,000 to 10,000, more preferably from 2,000 to 6,000 gausses. The temperature of the distillation residual oil on entry to the magnetic separator is in the range of room temperature to 400° C., preferably 150° C. to 350° C.

The linear velocity of the residual oil passing through the magnetic field space is 0.1 cm/sec. to 50 cm/sec., preferably 1.0 cm/sec. to 50 cm/sec., and should be reduced more the lower the rate of magnetization of or the smaller the size of iron particles to be separated.

According to the invention, the petroleum oil distillation residues after being removed of iron impurities will be subjected to a fixed-bed hydrogenation treatment at elevated temperature and pressure such as for desulfurization, denitrification and hydrogenative cracking. The fixed bed has a solid catalyst comprising a hydrogenation metal component such as a Group VIII and/or Group VI metal or metal compound including cobalt-molybdenum, nickel-molybdenum, nickel-tungsten, cobalt-molybdenum-nickel and platinum supported on a porous material such as alumina, silica-alumina or silica-magnesia.

The hydrogenation reaction according to the invention is effected at a temperature in the range of about 300°–480° C., a pressure in the range of about 50–200 kg/cm$^2$, preferably about 75–150 kg/cm$^2$, a liquid hourly space velocity (LHSV) in the range of about 0.1 to 10 hr$^{-1}$, preferably about 0.2–4 hr$^{-1}$ and a hydrogen-/oil ratio in the range of about 100–2,000 NI/l. The oil that has been thus hydrogenatively treated will be subsequently fractionated by distillation into certain classes of distillates and bottoms.

According to an important aspect of the invention, the ferromagnetic filler is cleaned by means of the aforementioned washing liquid for a time length of 1 minute to 6 hours, preferably 1 minute to 30 minutes at a liquid temperature of atmospheric temperature to 350° C., preferably atmospheric temperature to 200° C., at a liquid linear velocity of 0.1–50 cm/sec., preferably 1–10 cm/sec. and in the absence of magnetic fields.

The invention will be further described by way of example with reference to the accompanying drawing which schematically illustrates the flow of a feedstock oil through the various stages of treatment according to the process of the invention.

The feedstock oil, i.e. petroleum distillation residual oil, is fed through line 1 into a high gradient magnetic separator 10, in which instance a valve 2 upstream of and a valve 3 downstream of the separator are open and the remaining ON-OFF valves 4, 5 and 6 are closed. The feedstock oil on passage through the separator is removed of its iron impurities to some extent and sent into a hydrogenative treatment unit 20 via line 7. The feedstock oil thus treated is further fed via line 8 into a distillation column 30 where it is fractionated into a first distillate 9, a second distillate 11 and bottoms 12.

The amount of iron impurities being deposited on the ferromagnetic filler in the separator 10 increases progressively as the operation continues to a point where the efficiency of iron removal by the separator 10 declines sharply. At this time point, the valves 2 and 3 are closed and the valve 4 is opened to allow the feedstock oil to flow through a bypass line 13. The valve 6 is then opened to introduce the washing liquid through line 14 at a velocity of 1 cm/sec.–10 cm/sec. immediately followed by switching off the magnetic fields. The valve 5 is also opened to discharge the washing liquid, which has washed the particulate iron deposits off the filler, through line 15. About 10 minutes are required to resume normal operation of the system.

Inventive Examples 1–3 and Comparative Examples 1–2

A feedstock oil, i.e. a petroleum vacuum residual oil was treated with the use of a high gradient electromagnetic separator "SALA-HGMS" (registered trademark) under the following conditions:

| | |
|---|---|
| Strength of magnetic filed: | 3.0 kilogausses |
| Linear velocity: | 3.0 cm/sec. |
| Temperature: | 250° C. |
| Filler: | Bristo C (cup-shaped metal strips) |

The feedstock oil thus treated for iron removal was subjected to hydrogenative treatment with a catalyst comprised of an alumina carrier having supported thereon 5 percent by weight of each of Mo, Co and Ni under the following conditions:

| | |
|---|---|
| Reaction temperature: | 400° C. |
| LHSV: | 0.3 hr$^{-1}$ |
| Hydrogen partial pressure: | 120 kg/cm$^2$ |

The initial rate of iron removal was 60%, which over a period of a few hours declined to about 40%, when the washing operation of the filler was started with the introduction of a washing liquid (shown in Table 1). The washing operation was conducted under the following conditions:

Linear velocity of washing liquid: 2.0 cm/sec.

Temperature of washing liquid: 150° C.

Washing time length: 10 minutes

The extent to which the iron impurities have been washed away was determined by the rate of iron removal efficiency recovered upon re-start of the washing operation with the results shown in Table 1 which demonstrate superiority of the inventive washing liquids to the comparative counterparts.

TABLE 1

| | Wash Liquid (wt. %) | After-wash Iron Removal Rate (wt. %) |
|---|---|---|
| Inventive Example 1 | hydrogenation bottoms of vacuum residual oil | 60 |
| Inventive Example 2 | vacuum residual oil | 57 |
| Inventive Example 3 | atmospheric residual oil | 55 |
| Comparative Example 1 | straight-run naphtha | 44 |
| Comparative Example 2 | straight-run gas oil | 46 |

Inventive Examples 4 and 5

The washing operation according to the invention was conducted with the same magnetic separator as used in the preceding examples and with the use of two different types of ferromagnetic filler; namely, Bristo C and expanded metal for comparison purposes, under the following conditions.

Removal of iron impurities

-continued

| | |
|---|---|
| (in vacuum residual oil) | |
| Strength of magnetic field: | 3.0 kilogausses |
| Linear velocity: | 2.5 cm/sec. |
| Temperature: | 25° C. |
| Washing of filler | |
| Washing liquid: | hydrogenation bottoms of vacuum residual oil |
| Linear velocity: | 2.0 cm/sec. |
| Temperature: | 150° C. |

The results of iron removal and filler washing are shown in Table 2below.

TABLE 2

| | Filler | Initial Rate of Iron Removal (wt. %) | After-wash Rate of Iron Removal (wt. %) |
|---|---|---|---|
| Inventive Example 4 | Bristo C | 63 | 63 |
| Inventive Example 5 | Expanded metal | 60 | 57 |

What is claimed is:

1. A process for hydrogenatively treating petroleum distillation residual oils containing greater than 5 ppm iron impurities which comprises treating said residual oil at a temperature in the range of room temperature to 400° C. by flowing said residual oil through a ferromagnetic filler and magnetically attracting said iron impurities onto said ferromagnetic filler at a magnetic field strength in the range of 500 to 25,000 gausses generated in a high gradient magnetic separator; said ferromagnetic filler comprising cup-shaped metal strips of 0.1–5 mm in diameter; washing said ferromagnetic filler at predetermined intervals with a washing liquid selected from the group of a petroleum distillation residual oil, a hydrogenated fraction thereof and distillation bottoms of such hydrogenated fraction; said washing liquid being fed through the ferromagnetic filler in the same direction as the flow of residual oil through the ferromagnetic filler; and subsequently subjecting the thus treated residual oil to fixed-bed hydrogenation treatment.

2. A process as defined in claim 1 wherein said iron impurities are deposited on said ferromagnetic filler from said residual oil flowing at a linear velocity of 1–5 cm/sec.

3. A process as defined in claim 1 wherein said ferromagnetic filler is washed in demagnetized state for a time length of 1–30 minutes with said washing liquid fed at a linear velocity of 1–10 cm/sec. and a temperature of from atmospheric temperature to 200° C.

* * * * *